US007568588B2

(12) United States Patent
Yourist

(10) Patent No.: US 7,568,588 B2
(45) Date of Patent: Aug. 4, 2009

(54) CONTAINER WITH CONTOUR

(75) Inventor: Sheldon Yourist, York, PA (US)

(73) Assignee: Graham Packaging Company, L.P., York, PA (US)

( * ) Notice: Subject to any disclaimer, the term of this patent is extended or adjusted under 35 U.S.C. 154(b) by 350 days.

(21) Appl. No.: 11/204,010

(22) Filed: Aug. 16, 2005

(65) Prior Publication Data

US 2007/0039917 A1 Feb. 22, 2007

(51) Int. Cl.
*B65D 1/40* (2006.01)
*B65D 23/00* (2006.01)

(52) U.S. Cl. ..... 215/381; 215/379; 220/675

(58) Field of Classification Search ..... 215/373, 215/379–385, 398; 220/669, 672, 771, 666, 220/675

See application file for complete search history.

(56) References Cited

U.S. PATENT DOCUMENTS

| | | | | | |
|---|---|---|---|---|---|
| D31,126 | S | * | 7/1899 | Henius | D9/546 |
| D213,824 | S | * | 4/1969 | Luedtke | D9/560 |
| 3,526,506 | A | * | 9/1970 | Workman | 430/340 |
| 3,537,498 | A | * | 11/1970 | Amand | 604/403 |
| 3,708,082 | A | * | 1/1973 | Platte | 215/385 |
| D275,368 | S | * | 9/1984 | du Chambon | D9/520 |
| 5,117,993 | A | * | 6/1992 | Vesborg | 215/382 |
| D470,773 | S | * | 2/2003 | Darr et al. | D9/538 |
| 6,837,390 | B2 | * | 1/2005 | Lane et al. | 215/381 |
| 6,913,405 | B2 | * | 7/2005 | Fischer et al. | 401/6 |
| D525,138 | S | * | 7/2006 | Shmagin et al. | D9/538 |
| 2001/0054597 | A1 | * | 12/2001 | Ozawa et al. | 215/381 |
| 2002/0017502 | A1 | * | 2/2002 | Renz | 215/384 |
| 2003/0000911 | A1 | * | 1/2003 | kelley et al. | 215/381 |
| 2003/0221987 | A1 | * | 12/2003 | Trude | 206/508 |
| 2006/0054587 | A1 | * | 3/2006 | Oguchi et al. | 215/381 |

FOREIGN PATENT DOCUMENTS

| | | | | |
|---|---|---|---|---|
| JP | 2001315741 | A | * | 11/2001 |
| JP | 2002145235 | A | * | 5/2002 |
| JP | 2002326619 | A | * | 11/2002 |
| JP | 2003104347 | A | * | 4/2003 |
| JP | 2004292045 | A | * | 10/2004 |
| WO | WO 2004037658 | A1 | * | 5/2004 |

* cited by examiner

*Primary Examiner*—Sue A Weaver
(74) *Attorney, Agent, or Firm*—Knoble Yoshida & Dunleavy, LLC

(57) ABSTRACT

The present invention relates to a plastic container with a substantially circular base, a lower body portion, a mid body portion, and an upper body portion, each having a respective width. The lower body portion is connected to the base and the mid body portion, the mid body portion lies between the lower and upper body portion, and the upper body portion is between the mid body portion and container neck. The mid body portion contains a substantially flat portion, with the flat portion merging into the upper and lower body portions. The container also has a waist located at approximately the center of the mid body portion, the waist having a width.

16 Claims, 3 Drawing Sheets

CONTAINER WITH CONTOUR

BACKGROUND OF THE INVENTION

1. Field of the Invention

The present invention relates generally to a hollow blow-molded container, and more particularly to a uniformly shaped blow-molded container able to accommodate a hot-fill and sealing process without distortion.

2. Description of Related Art

Plastic containers adapted for hot filling and sealing are known in the art. However, producing a container that is able to withstand vacuum forces created by the process of hot-filling, capping, and cooling the container, while maintaining its structural integrity, still presents a challenge.

Many plastic containers utilize flexible panels to accommodate internal vacuum forces. U.S. Pat. Nos. 5,141,120 and 5,141,121 to Brown et al. disclose a hot fill container having opposing pinch grip indentations in the sidewall. These indentations collapse inwardly towards each other to accommodate internal forces that result from filling the container with high temperature liquid. U.S. Pat. No. 5,392,937 and Des. 344,457 to Prevot et al. disclose a grip structure that moves with the vacuum flex panel in response to the internal vacuum. Agrawal et al., U.S. Pat. No. 4,497,855 discloses a container with a plurality of recessed collapsed panels, separated by land areas, that allow uniform inward deformation under vacuum force.

However, the use of flex panels has its own limitations. Due to the increased amount of force transferred to the side walls, the amount of flex in each panel is limited. Thus, there is a need in the art for a container that is suitable for hot-fill processes that does not rely on the use of flex panels.

BRIEF SUMMARY OF THE INVENTION

The present invention is directed to a plastic container having upper, lower, and mid body portions, the base and body portions each having a respective width. In one preferred embodiment, the base is substantially circular. The lower body portion is connected to the base, the mid body portion is connected to the lower body portion, and the upper body portion is connected to the mid body portion at the end opposite to the lower body portion. A neck is connected to the upper body portion.

A substantially flat concave portion exists within the mid body portion, and this flat portion merges into the upper and lower body portions. There is also a waist at approximately the center of the mid body portion, the waist having a width. The width of the lower body portion can be equal to the width of the upper body portion. Further, the width of the lower body portion and the width of the upper body portion can be greater than the width of the base, and the width of the waist can be less than the width of the base. The mid body portion can have four substantially flat portions. In one embodiment of the invention, the flat concave portion is oval shaped. The waist can be substantially square in cross section, and can be situated evenly between the neck and the base. In a preferred embodiment of the invention, the flat portion of the container flexes inwardly and uniformly upon hot-filling and sealing of the neck with a closure.

The present invention is further directed to a container sidewall having the inventive features as described above.

The present invention is also directed to a method of minimizing asymmetrical distortion of a container upon hot filling and sealing of the container by manufacturing the container has described above.

This invention provides a container that is suitable for hot-fill application without the problems that exist in conventional solutions. The container provides for uniform distribution of internal vacuum forces, and does not require the presence of a flex panel, thus overcoming the challenges of the prior art.

Further objectives and advantages, as well as the structure and function of the preferred embodiments, will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

FIG. 3A depicts;

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Figure 1:
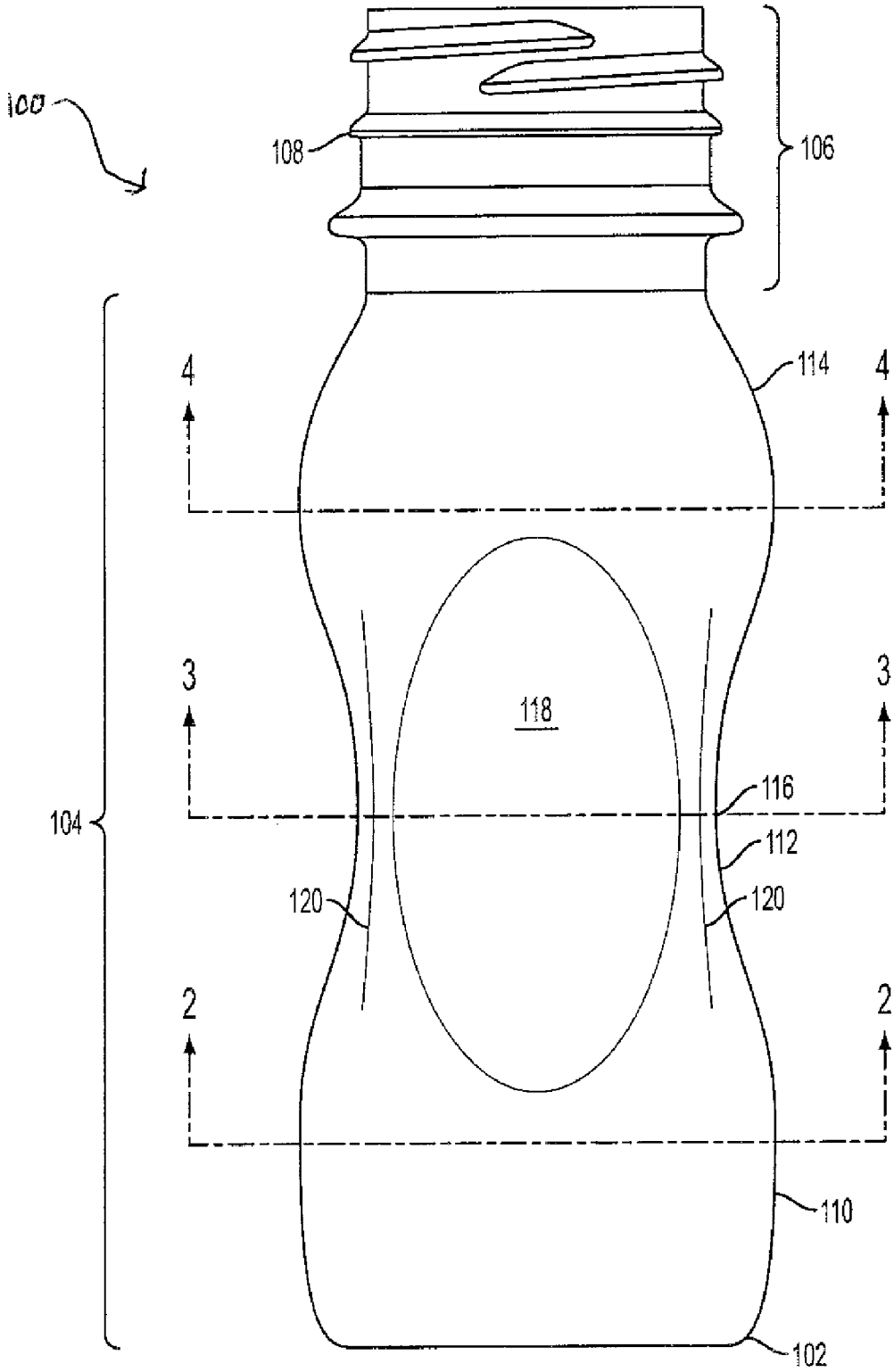
FIG. 1 depicts a front view of the container according to one embodiment of the present invention.

The embodiment of container 100 as illustrated in FIG. 1 has a base 102, with body 104, and neck 106 with finish 108. The container body 104 can be described as having three portions: a lower body portion 110, a substantially flat mid body portion 112, and an upper body portion 114. The lower body portion 110 is situated between the base 102 and a mid body portion 112, the mid body portion is located between the lower body portion 110 and upper body portion114, and the upper body portion 114 sits between the mid body portion 112 and the neck 106.

Figure 2:
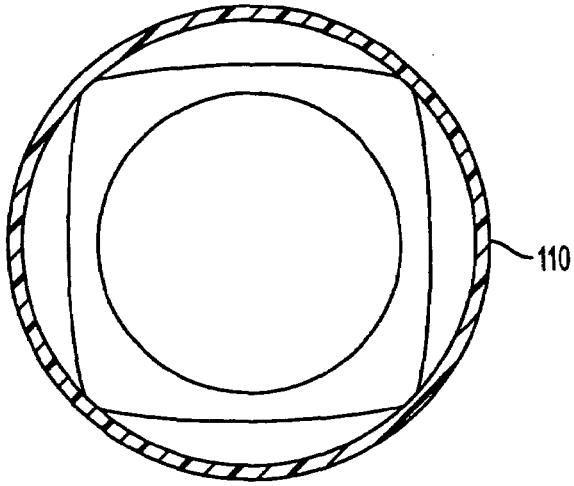
FIG. 2 depicts a cutaway view of the container of FIG. 1 along line 2-2 looking up according to the present invention

As depicted in FIG. 1, the base 102 is substantially circular and has rounded edges. In progressing from the base 102 to the lower body portion 110, the rounded edges bow outwardly away from the center of the container, such that the circumference of the container body increases when moving upwards, away from the container base 102. The container then reaches a maximum circumference, which is approximated by line 2-2 in FIG. 1. The cross section of the container at this maximum point is substantially circular, as shown in FIG. 2. The portion of the container which begins at the rounded base edges defines the lower body portion 110. In the illustrated embodiment of FIG. 1, the lower body portion 110 is rounded.

Moving upwards along the container body from line 2-2, the circumference of the container body begins to decrease as the container sidewall starts to bow inwardly. The circumference of the container continues to decrease, and the rounded shape of the lower body portion 110 transitions to a substantially flat sidewall flanked by corners, or corner edges 120, on either side (see also FIGS. 3 and 5). This portion where the sidewall is substantially flat is the central surface 118 of the present invention. The corners form the corner edges 120, that run along the central surface 118.

Figure 3:
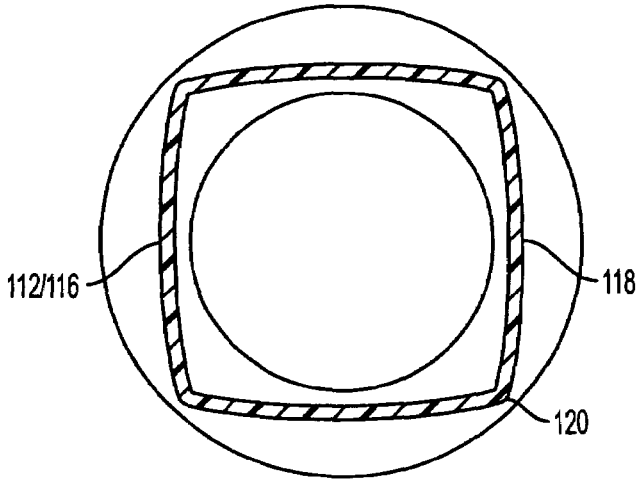
FIG. 3 depicts a cutaway view of the container of FIG. 1 along line 3-3, looking up according to the present invention.

As illustrated in FIG. 3, the cross section of the container at the mid body portion 112 is substantially square. The corner edges 120 can vary from the illustrated sharp transition to a slightly more rounded configuration. This tightening of the rounded container body to a substantially square-shaped container body occurs within the mid-body portion 112. The container sidewall along the mid-body portion 112 is substantially flat, but bows slightly inward towards the center of the container 100. Thus, the container sidewall at the mid-body portion 112 is slightly concave in the vertical direction. This substantially flat but slightly concave portion of the sidewall, the central surface 118, is visible in FIGS. 1, 3, and 5. On either side of the central surface 118 is a corner edge 120.

At the center of the mid-body portion is a container waist 116, where the container body 104 is substantially square-shaped. The waist 116 is located approximately at line 3-3, and has the cross section shown in FIG. 3. As illustrated in FIG. 3, the sides of the square (formed by the central surface 118) bow outwardly and are slightly rounded, and the portion of the sidewall adjacent to the central surface 118 tightens to form the corner edge 120. In the illustrated embodiment, corner edges 120 are only present in the mid-body portion.

Figure 5:
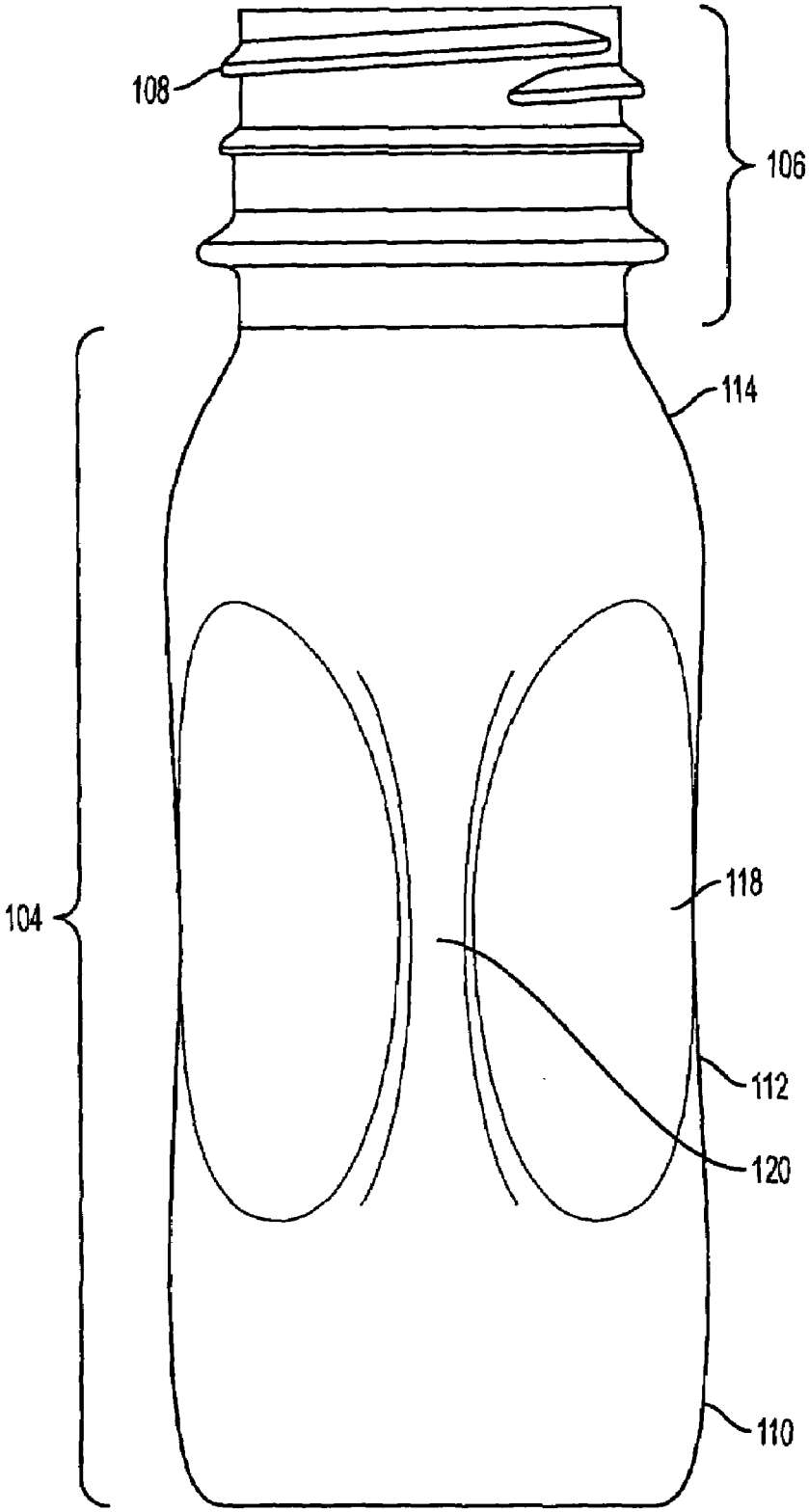
FIG. 5 depicts a side view of the container according to one embodiment of the present invention, rotated 45° from FIG. 1.

FIG. 5 is a side or edge view of container 100, which illustrates the corner edge 120 of the present invention. The corner edge 120 is present in the mid body portion 112 adjacent to the central surface 118. The corner edge 120 develops as the rounded lower body 110 transitions to the mid-body portion 112, the mid body portion 114 having a substantially square cross section. The corner edge 120 is present along the mid body portion 112, then begins to loosen and disappear as the mid body portion 112 transitions to the upper body portion 114. More specifically, the corner edges 120 begin to disappear as the container body 104 once again expands in circumference and takes on a circular shape, as shown in, FIG. 5. In this illustrated embodiment, there are four corner edges 120 separating four central surfaces 118. However, containers having 3, 5, 6 or more sides are within the scope of the invention.

Figure 4:
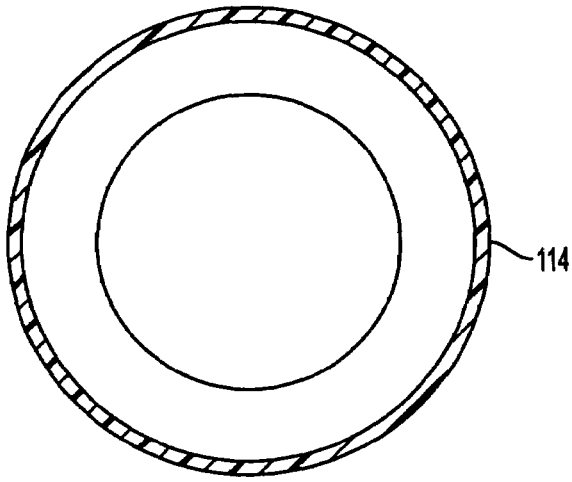
FIG. 4 depicts a cutaway view of the container of FIG. 1 along line 4-4, looking up according to the present invention.

Continuing upwards along the container 100, the body 104 begins to again bow outwardly. This rounding of the container body 104 and increase in circumference occurs where the mid-body portion 112 merges with the upper body portion 114. Like the lower body portion 110, the upper body portion 114 of FIG. 1 is rounded at and around the mid-section. The circumference of the container upper body 114 reaches a maximum point at approximately line 4-4 of FIG. 1. The circular cross section of the container 100 at this maximum point is illustrated at FIG. 4. From line 4-4 moving upwards, the container circumference decreases until the upper body portion 114 merges with the neck 106. The neck 106 can include a finish 108 for attaching a closure, which can be, for example, threads. Other closure attachment structures known in the art can also be used.

The present invention is also directed to a method of blow molding the container 100 described above. The method of blow molding can be injection, stretch, or extrusion blow molding. In an exemplary embodiment, the container is prepared by extrusion blow molding.

The container can be blow molded from a thermoplastic material. The container can be made of a polyolefin such as polyethylene, for example low density polyethylene (LDPE) or high density polyethylene (HDPE), or polypropylene; a polyester, for example polyethylene terephthalate (PET), polyethylene naphtalate (PEN); or others, which can also include additives to vary the physical or chemical properties of the material.

In the illustrated embodiment, there are four central surfaces 118 separated by four corner edges 120. The central surfaces 118 are substantially flat and are present primarily on the mid body portion. Accordingly, the corner edges 120 exist only in the mid body portion 112. However, embodiments where the central surfaces 120 extend further into the lower 110 and upper body portions 114 are also possible. The central surfaces are also depicted as oval shaped in the Figures, but other circular or polygonal shapes are possible.

As depicted in the Figures, the diameter, or width, of the lower body 110 and upper body portions 114 are approximately equal. The widths of the upper 114 and lower body portions 110 are also greater than the width or diameter of the waist 116 of the mid body portion 112. However, varying, asymmetrical dimensions, are also within the scope of this invention. Also, as discussed above, the base can circular, but it can also can be a variety of other suitable shapes, such as square-like, elliptical, triangular, rectangular, and others.

The central surface 118 of the present invention eliminates or minimizes distortion in response to internal vacuum pressure that results from hot filling and capping the container 100 by the migration of the substantially flat geometry of the central surface 118 into the upper 114 and lower rounded body portions 112. The present container 100 can be filled at a temperature of approximately 85° C. (185° F.), and can withstand temperatures of up to 87.78° C. (190° F.). Upon sealing, the central surface 118 flexes inwardly and evenly, distributing the vacuum forces such that the upper 114 and lower body portions 110 become a more flattened shape where the upper 114 and lower body portions 110 meet the mid body portion 112. Again, the distribution of vacuum force, and thus the migration of the flat geometry into the upper 114 and lower body portions 110 occurs uniformly, such that the overall shape of the container 100 is maintained. As a result, container deformations such as buckling, collapse, or other undesirable side effects due to uneven distribution of vacuum forces are virtually eliminated. The end result is a highly attractive container, manufactured without the requirement of a flex panel.

The elimination of the conventional flex panel from the container has several advantages. One major benefit is easier manufacture, since the container 100 has less complicated components. This is particularly desirable in embodiments of the invention where the container 100 is small. In certain preferred embodiments, the present container 100 can be approximately four to six inches in height. Designing a flex panel for a container of this size can be a challenge, and the elimination of the flex panel facilitates manufacture. Without the requirement of a flex panel, it is easier to manufacture bottles of a smaller size. A small size is often desirable when manufacturing products for consumption, as it reduces content waste. This is particularly advantageous when the consumer is a child or any individual who does not want to consume a larger quantity of food/beverage. The small size also makes the product more portable, fitting easily into a purse, backpack, lunch box, or even a pocket. Further, certain products, such as vitamin supplements or nutritional drinks are only meant to be consumed in small quantities. The present invention is appropriate for all these uses. Of course, the present container is well-suited to be used in the manufacture of bottles of various sizes, including standard and larger size drink bottles.

Another benefit of the present invention is that the lack of panels makes for an aesthetically pleasing container. This is particularly apparent if the container is placed in a shrink sleeve. The lack of panels allows the shrink sleeve to neatly silhouette the shape of the container, without leaving any gaps between the container body and the sleeve.

The presently claimed container is suitable for holding, for example, fruit drinks, dairy-based drinks, shakes, energy/sports drinks, health drinks/nutritional supplements, and so on. The container is also suitable for gels, viscous liquids, and pourable solids.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A plastic container comprising:

a base having a width;

a lower body portion connected to the base, the lower body portion having a first width;

a mid body portion connected to the lower body portion;

an upper body portion connected to the mid body portion at the end opposite to the lower body portion, the upper body portion having a second width;

a neck connected to the upper body portion;

a substantially flat central surface within the mid body portion, the central surface merging into the upper and lower body portions, said substantially flat central surface bowing inwardly towards a waist, so as to minimize distortion from hot filling;

the waist located at approximately the center of the mid body portion, the waist having a third width;

and;

wherein the lower body portion has a substantially circular cross-section, the upper body portion has a substantially circular cross-section and the mid body portion having a substantially square cross-section.

2. The container of claim 1, wherein the first width of the lower body portion is approximately equal to the second width of the upper body portion.

3. The container of claim 1, wherein the substantially flat central surface is oval shaped.

4. The container of claim 1, wherein the mid body portion comprises four substantially flat central surfaces.

5. The container of claim 1 wherein the waist is substantially square in cross section.

6. The container of claim 1, wherein the substantially flat central surface has been adapted to flex inwardly and unifomily upon hot-filling and sealing of the neck with a closure.

7. The container of claim 1, wherein the waist is situated approximately evenly between the neck and the base.

8. A thermoplastic container sidewall comprising:

a lower body portion having a first width;

a mid body portion connected to the lower body portion;

an upper body portion connected to the mid body portion at the end opposite to the lower body portion, the upper body portion a second width;

a substantially flat central surface within the mid body portion the central surface merging into the upper and lower body portions, said substantially flat central surface bowing inwardly towards a waist so as to minimize distortion from hot filling;

the waist located at approximately the center of the mid body portion, the waist having a third Width; and wherein the substantially flat central surface has been adapted to flex inwardly and uniformly when the container is hot-filled and sealed with a closure.

9. The sidewall of claim 8, wherein the first width of the lower body portion is approximately equal to the second width of the upper body portion.

10. The sidewall of claim 8, wherein the substantially flat central surface is oval shaped.

11. The sidewall of claim 8, wherein the first width of the lower body portion and the second width of the upper body portion is greater than the third width of the waist.

12. The sidewall of claim 8 wherein the substantially flat central surface is one of four substantially flat central surfaces comprising the mid body portion.

13. The sidewall of claim 8 wherein the substantially flat central surface forms a portion of the waist, where the waist is substantially square in cross section.

14. A method of minimizing asymmetrical distortion of a thermoplastic container upon hot filling and sealing of the container, the method comprising:

manufacturing a container, the container comprising:

a base, a lower body portion connected to the base, the lower body portion having a first width, a mid body portion connected to the lower body portion, an upper body portion connected to the mid body portion at the end opposite to the lower body portion, the upper body portion having a second width, a neck connected to the upper body portion, a substantially flat central surface within the mid body portion, the central surface merging into the upper and lower body portions, said substantially flat central surface bowing inwardly towards a waist so as to minimize distortion from hot filling, and the waist located at approximately the center of the mid body portion, the waist having a third width;

filling the container with a hot liquid;

sealing the container with a closure; and allowing the filled and sealed container to cool.

15. The method of claim 14, wherein the substantially flat central surface flexes inwardly and uniformly upon hot-filling and sealing.

16. The method of claim 14, wherein the mid-body portion comprises four substantially flat central surfaces.

* * * * *